US005882233A

United States Patent [19]

Idehara

[11] Patent Number: 5,882,233

[45] Date of Patent: Mar. 16, 1999

[54] PIN PLUG INCLUDING CONDUCTIVE INSERT

[75] Inventor: Tsuru Idehara, Tokyo, Japan

[73] Assignee: Suntec & Co., Ltd., Tokyo, Japan

[21] Appl. No.: 807,815

[22] Filed: Feb. 26, 1997

[51] Int. Cl.[6] ..... H01R 4/10

[52] U.S. Cl. ..... 439/877; 439/585

[58] Field of Search ..... 439/877, 879, 439/948, 585

[56] References Cited

U.S. PATENT DOCUMENTS

| | | | |
|---|---|---|---|
| 2,478,082 | 4/1949 | Broske | 439/879 |
| 4,272,150 | 6/1981 | Fairbairn | 439/879 |
| 4,572,605 | 2/1986 | Hess | 439/877 |
| 4,966,560 | 10/1990 | Marzouk | 439/877 |
| 5,408,743 | 4/1995 | Toumier et al. | 439/877 |

FOREIGN PATENT DOCUMENTS

| | | | |
|---|---|---|---|
| 1005808 | 4/1952 | France | 439/877 |

*Primary Examiner*—Gary Paumen
*Assistant Examiner*—Tho Dac Ta
*Attorney, Agent, or Firm*—Wenderoth, Lind & Ponack, L.L.P.

[57] ABSTRACT

A pin plug includes a hollow conductive pin having an opening at one end, an insulation member secured around the pin, a conductive member attached to the insulation member so as not to be contacted with the pin, and a conductor lead of the coaxial cable type and having a core wire which is inserted into the pin through the opening and is electrically and mechanically connected to the pin and shield lines which are electrically connected to the conductive member. A hollow conductive insert is inserted into the pin, and the core wire is inserted into the insert. The insert is crimped and deformed by crimping a predetermined portion of the pin, thereby integrally securing the core wire, insert and pin together and providing an electrical and mechanical connection therebetween.

5 Claims, 7 Drawing Sheets

PIN PLUG INCLUDING CONDUCTIVE INSERT

BACKGROUND THE INVENTION

1. Field of the Invention

The present invention relates to a pin plug for electrically connecting between various elements, for example, between electronic equipments, between an equipment and an electric power source or between conductor leads. More particularly, the invention relates to a pin plug adapted to be attached to an end of a conductor lead to be connected to a pin jack.

2. Related Background Art

In an example of a conventional pin plug, as shown in FIG. 1, a lower end of a hollow pin 31 is fixedly embedded into a resin insulation member 32 by a resin-injection molding process, and a metal spring sleeve 33 is fitted around an outer peripheral surface of the insulation member 32. A solder material 34 is previously inserted into the pin 31. A core wire 36 of a conductor lead 35 of coaxial cable type is inserted into the pin 31, and shield wires 37 are connected to the spring sleeve 33. Thereafter, the solder material 34 is heated and melted, with the result that the core wire 36 is electrically and mechanically secured to an inner surface of the pin 31. Then, a resin cap 38 is attached so as to surround the metal spring sleeve 33 and the conductor lead 35.

However, the above-mentioned conventional example has the following disadvantages:

(1) Since a soldering operation space for treating the solder material 34 is small, it is difficult to perform the soldering operation, and the soldering operation therefore requires expert skill. Accordingly, there can be uneven strength in the connection between the pin 31 and the core wire 36, resulting in poor conductivity and frequent disconnection of the core wire from the pin.

(2) Harmful gas generating from solder flux during the soldering operation can be a bad influence upon an operator's health. Although flon gas frequently has been used to clean the soldering bath and/or to remove the flux, flon gas has recently been inhibited from use because it destroys the ozone layer.

In another conventional example, core wire 36 is engaged with a protruded portion integrally formed with a lower end of pin 31, and the protruded portion is deformed by caulking or crimping to electrically connect the core wire 36 to the pin 31. However, this technique has the following disadvantage:

(3) A process for integrally forming the protruded portion on the pin 31 is troublesome, and it is difficult to automatically perform the engaging operation (for engaging the core wire with the protruded portion) and the caulking or crimping operation, and such operations become unstable frequently, thereby causing uneven or poor mechanical connection and electrical conductivity between the pin and the core wire.

(4) In a further conventional example, core wire 36 is inserted into a hollow portion of pin 31 and the pin 31 itself is deformed so as to contact with the core wire 36 by caulking the pin 31. However, in this case, since an amount of deformation of the pin 31 is limited from the viewpoint of the appearance of the pin, the contact between the pin and the core wire is inadequate, and thus good mechanical connection and electrical conductivity (between the pin and the core wire) cannot be achieved.

SUMMARY OF THE INVENTION

An object of the present invention is to provide a pin plug which can eliminate the need for a soldering operation and can achieve an effective caulking without creating a gap between an inner surface of a pin and a core wire of a conductor lead by inserting the core wire into a conductive insert which is previously disposed within the pin and then by deforming the pin, insert and core wire simultaneously by a crimping operation.

Another object of the present invention is to provide a pin plug in which an insert has a large diameter portion and a small diameter portion, and the large diameter portion is press-fitted against an inner surface of the pin so that the insert is prevented from being shifted during a crimping operation.

To achieve the above objects, according to one aspect of the present invention there is provided a pin plug comprising a hollow conductive pin having an opening at one end, an insulation member secured around the pin, a conductive member attached to the insulation member so as not to contact with the pin, a conductor lead of the coaxial cable type having a core wire which is inserted into the pin through the opening and is electrically and mechanically connected to the pin, and shield lines which are electrically connected to the conductive member, and a hollow conductive insert inserted into the pin, the core wire inserted into the pin further being inserted into the insert, the insert being deformed by crimping a predetermined portion of the pin, thereby integrally securing the core wire, insert and pin together, to provide electrical and mechanical connection therebetween.

The above-mentioned pin plug provides the following advantages:

(1) Since the crimping operation can be performed by using a punch and the like, the crimping operation can be easily performed uniformly and effectively by any person without expert skill even within a narrow space, in contrast to a soldering operation, the strength of the mechanical connection between the pin and the core wire is stabilized, the electrical conductivity between the pin and the core wire is improved, and disconnection of the core wire from the pin can be prevented, thereby obtaining uniform and high quality articles.

(2) Since there is neither generation of harmful gas from the flux used in a soldering operation nor the need to use flon gas (because the soldering operation can be omitted), the operator's health is not subjected to such dangerous conditions and danger to the ozone layer can be prevented.

(3) Since there is no need to form a protruded portion on the pin to connect the core wire to the pin, the manufacturing process of the pin is simplified. Further, since there is no need to perform the troublesome connection between the protruded portion and the core wire, reliability of the article and operability thereof are improved.

(4) Since the crimping operation is performed after the core wire is inserted into the insert which is previously inserted within the pin, a gap between an outer diameter of the core wire and an inner diameter of the insert becomes very small, with the result that, when the pin is deformed by the crimping operation, the pin is adequately urged against the core wire, thereby not only protecting the appearance of the pin itself but also providing good mechanical connection and electrical conductivity between the pin and the core wire.

According to another aspect of the present invention, the insert has a large diameter portion provided at a lower portion of the insert and having a diameter slightly greater than the inner diameter of the pin, a small diameter portion provided at an upper portion of the insert and having a diameter slightly smaller than the inner diameter of the pin, a central bore including at least a bore portion having an inner diameter corresponding to an outer diameter of the core wire, and a lower end opening. With this arrangement, the insert is inserted into the pin through the opening thereof so that the large diameter portion is press-fitted against the inner peripheral surface of the pin to secure the insert to the pin. When the core wire of the conductor lead is inserted into the bore portion of the insert, a portion of the pin corresponding to the bore portion is crimped and deformed, thereby integrally securing the core wire, insert and pin together.

The above-mentioned pin plug provides the following advantages:

(5) Since the large diameter portion of the insert is firmly press-fitted against the inner surface of the pin, during the crimping operation, the insert can be displaced neither in an axial direction nor in a direction perpendicular thereto, with the result that a stable crimping condition can be achieved, thereby providing more stable mechanical connection and electrical conductivity between the pin and the core wire.

(6) Since the inner diameter of the insert corresponds to the outer diameter of the core wire to provide no gap therebetween, there is no place where the core wire escapes during the crimping operation. Thus, the deformed portion of the insert is effectively penetrated into the core wire, thereby providing more stable mechanical connection and electrical conductivity between the core wire and the pin.

According to a further aspect of the present invention, an insert includes at least three portions having gradually decreasing outer diameters from a bottom of the insert, i.e. a large diameter portion, an intermediate diameter portion and a small diameter portion. Thus, when the insert is inserted into the pin, the large and intermediate diameter portions are press-fitted against the inner peripheral surface of the pin.

(7) With this arrangement, since the two outer diameter portions of the insert having different outer diameters are steppingly press-fitted against the inner surface of the pin, even if there is variation in dimension between an inner diameter of each of the pins and an outer diameter of each of the insert, such variation is accommodated by the two outer diameter portions of the insert, thereby always achieving a good press-fit condition of the insert and providing a more stable construction.

DESCRIPTION OF THE PREFERRED EMBODIMENTS

The present invention will now be explained in connection with embodiments thereof with reference to the accompanying drawings.

Figure 1:
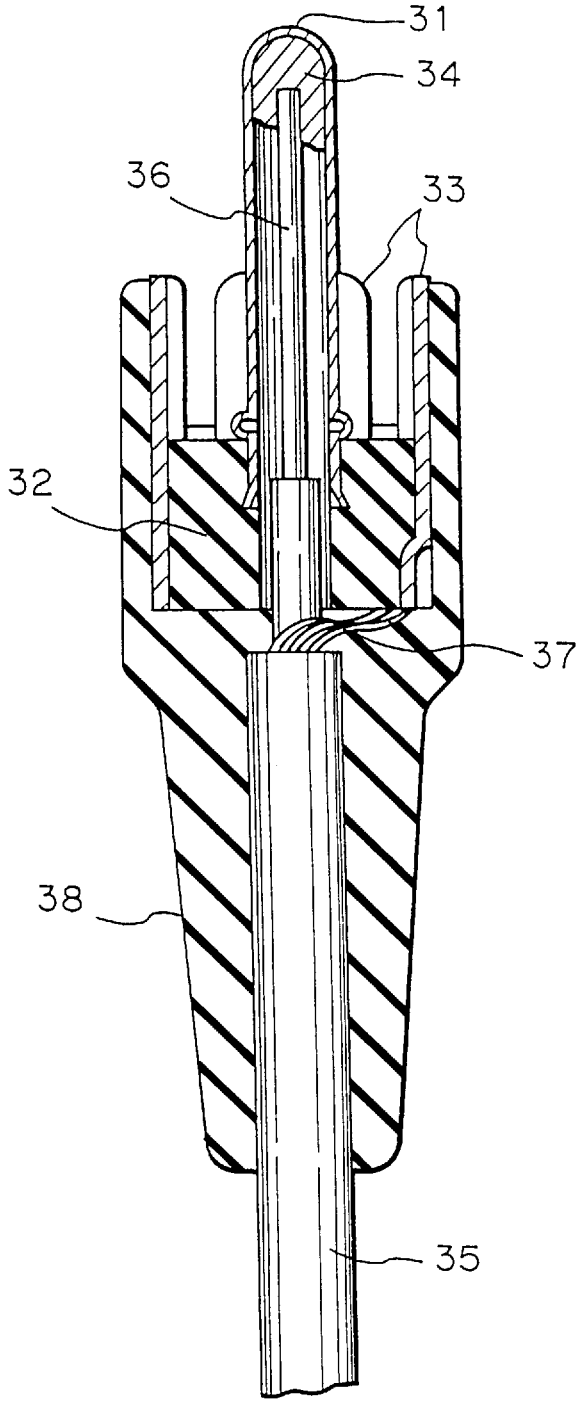
Fig. 1 (PRIOR ART)
FIG. 1 is a sectional view of a conventional pin plug.
Figure 2:
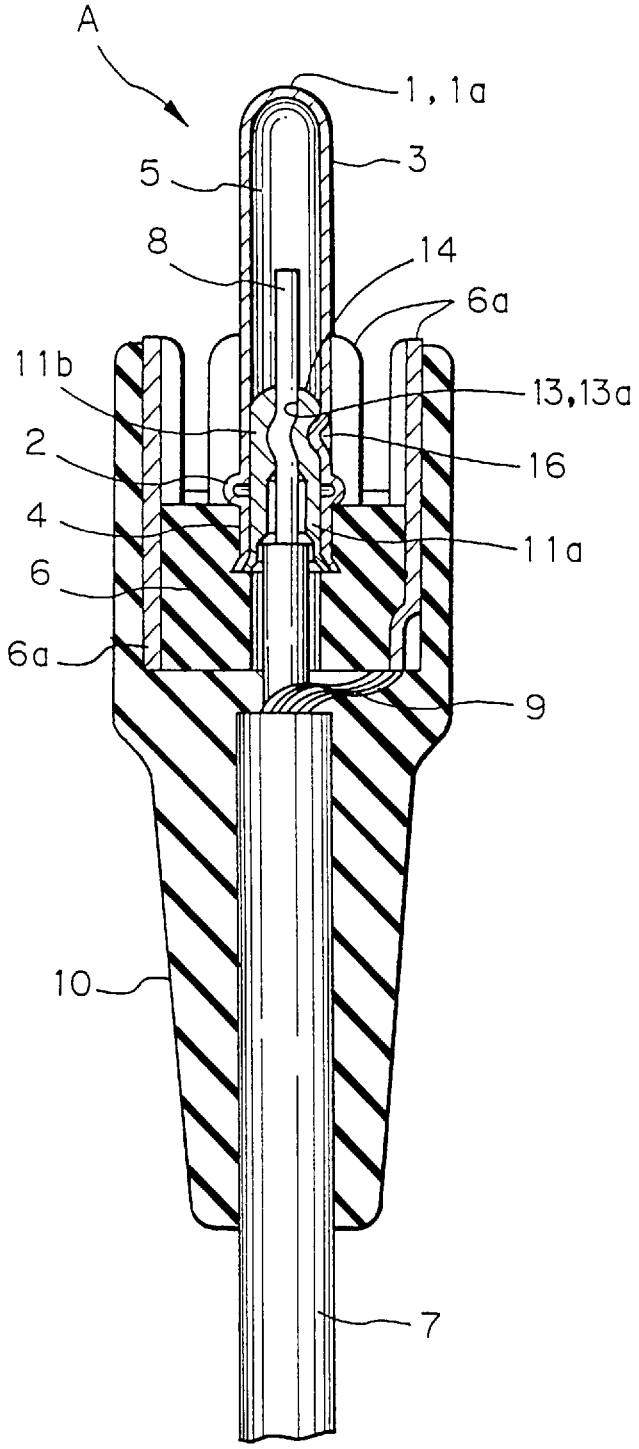
FIG. 2 is a sectional view of a pin plug according to an embodiment of the present invention.
Figure 4A:
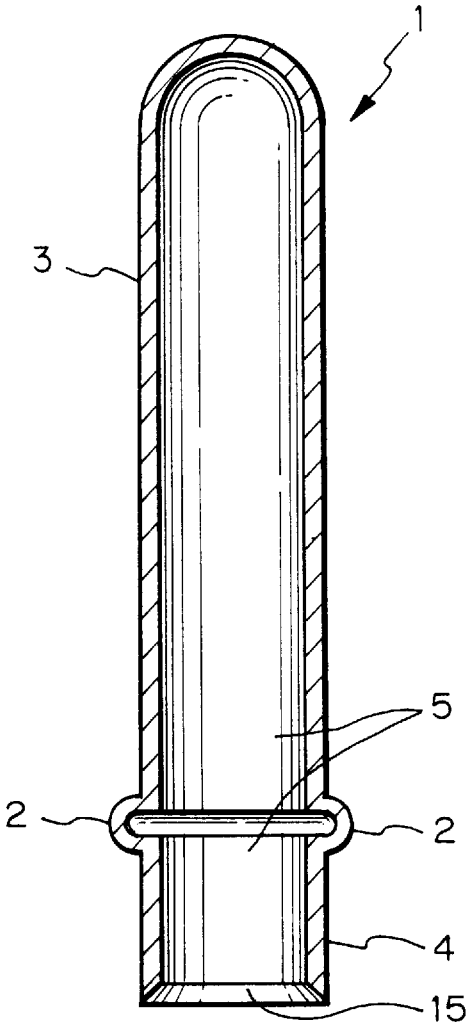
FIG. 4(A) is a sectional view of a pin of the pin plug of FIG. 2.
Figure 4B:
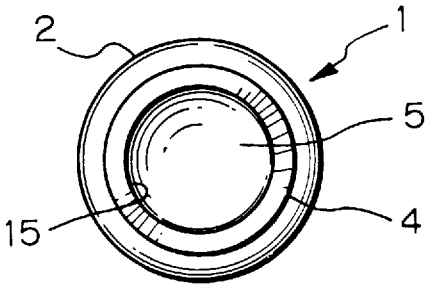
FIG. 4(B) is a plan view of the pin.

In FIG. 2, a pin 1 is made of brass which is electroplated by nickel, for example. As shown in FIGS. 2 and 4, the pin comprises a cylindrical hollow pin portion 3. The pin portion 3 has an inner hollow portion 5, an enlarged flange portion 2 disposed in the vicinity of a lower end opening 15, and an attachment portion 4 disposed between the lower end opening 15 and the flange portion 2.

As shown in FIG. 2, a cylindrical resin insulation member 6 is attached to an outer peripheral surface of the attachment portion 4 of the pin 1, and a spring sleeve 6*a* (of the four-spring type in the illustrated embodiment) is fitted onto an outer peripheral surface of the insulation member 6.

A conductor lead 7 of the coaxial type includes a core wire 8 and shield lines 9.

Figure 3:
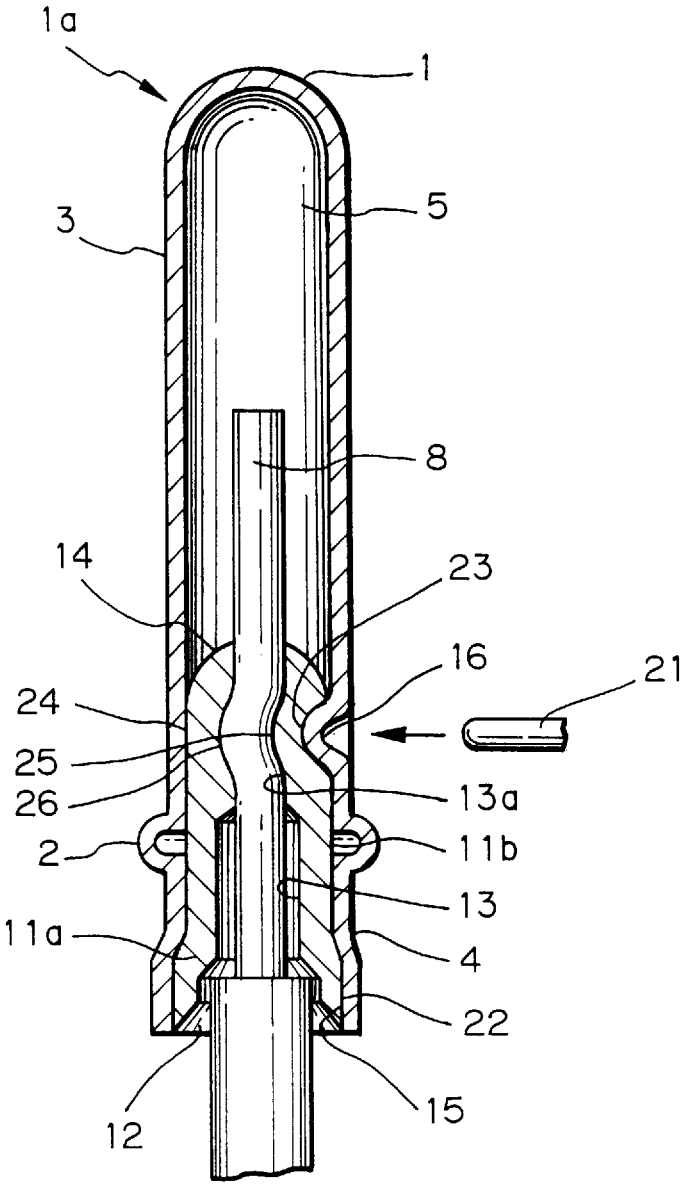
FIG. 3 is an enlarged sectional view of a main portion of the pin plug of FIG. 2.
Figure 5A:
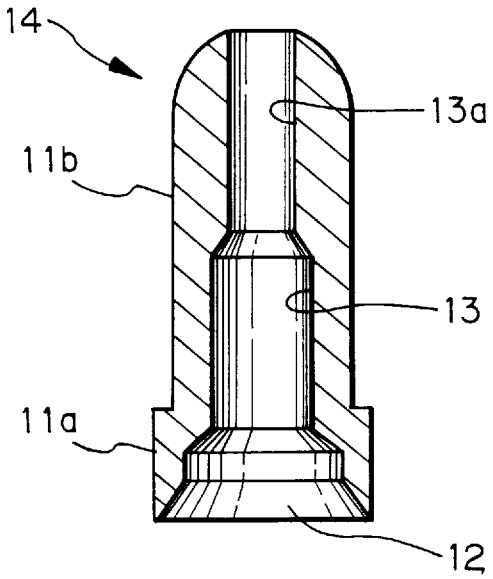
FIG. 5(A) is a sectional view of an insert of the pin plug of FIG. 2.
Figure 5B:
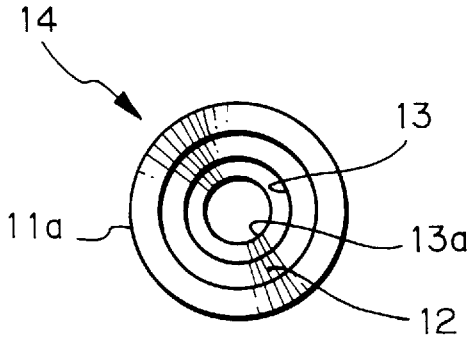
FIG. 5(B) is a plan view of the insert.

A cylindrical insert 14 is made of copper or other metal (for example, aluminum) having high conductivity, or is made of a high conductivity resin. As shown in FIGS. 3 and 5, the insert 14 has a lower or outer large diameter portion 11*a,* and upper or inner small diameter portion 11*b,* a lower end opening 12, and a central bore 13 including an upper or inner small diameter bore portion 13*a*. These elements 11*a,* 11*b,* 12, 13 and 13*a* have predetermined axial lengths. In this case, the large diameter portion 11*a* has an outer diameter slightly greater than an inner diameter of the attachment portion 4 of the pin 1, and the small diameter portion 11*b* has an outer diameter slightly smaller than an inner diameter of the pin portion 3 (or hollow portion 5). Further, the central bore 13 has an inner diameter considerably greater than an outer diameter of the core wire 8, and the small diameter bore portion 13*a* has an inner diameter substantially the same as an outer diameter of the core wire 8.

The reference numeral 10 denotes a cap made of insulation resin or the like.

Next, the assembling process of the pin will be explained. First of all, as shown in FIG. 3, the insert 14 is inserted into the pin 1 through the lower end opening 15 in such a manner that the lower large diameter portion 11*a* of the insert 14 is press-fitted against the inner peripheral surface of the attachment portion 4 of the pin 1 to form a press-fit portion 22. In this way, a pin/insert assembly 1*a* having the insert 14 firmly attached to the pin 1 is obtained.

Then, the pin/insert assembly 1*a* is subjected to a resin injection-molding process, where, as shown in FIG. 2, the resin insulation member 6 is integrally formed around the attachment portion 4 of the pin 1 by injection-molding. Incidentally, the formation of the insulation member 6 is not limited to injection-molding, but, the pin/insert assembly 1*a* may be press-fitted into a central bore of a solid insulation member 6.

Then, the conductor lead 7 is inserted into the insert 14 through the lower end opening 12 of the insert 14 of the pin/insert assembly 1*a* attached to the insulation member 6. As a result, the core wire 8 passes through the central bore 13 and the small diameter bore portion 13*a* of the insert 14 successively in an upward direction in FIG. 3 (the insulation member 6 is omitted from illustration) to protrude into the hollow portion 5, in a state that the core wire 8 closely contacts with the inner peripheral surface of the small diameter bore portion 13*a*. Alternatively, the core wire 8 need not be protruded above the insert 14 so long as the core wire is inserted into the bore portion 13*a* of the insert 14 by a predetermined length.

Then, in FIG. 3, by using a caulking or crimping punch 21 having a spherical-shaped tip, a predetermined portion of the pin 1 situated slightly above the flange portion 2 and corresponding to the small diameter bore portion 13*a* of the insert 14 is caulked or crimped and deformed inwardly from the right to the left (in FIG. 3) by a caulking or crimping process, thereby forming a caulked or crimped portion 16. As a result, in correspondence to the portion 16 of the pin 1, an inwardly deformed and protruded caulked or crimped portion 23 is formed. Further, in correspondence to the portion 23, a corresponding portion of the small diameter portion 13*a* of the insert 14 is also deformed inwardly to penetrate into the core wire 8, thereby forming another inwardly protruded caulked or crimped portion 25. Consequently, an opposed portion of the core wire 8 is penetrated into an opposite portion of the small diameter bore portion 13*a* of the insert 14, thereby forming an opposite caulked or crimped portion 26. Incidentally, the opposite portion 26 need not necessarily be formed.

Accordingly, the insert 14 is firmly held with respect to the pin 1 by the portion 23 and the press-fit portion 22 and is electrically coupled to the pin 1, at least by portions 23, 22. Further, the core wire 8 is firmly held with respect to the insert 14 by the portions 25, 26 situated on opposite sides of the small diameter bore portion 13*a* and electrically coupled to the insert 14, at least by portions 25, 26.

Therefore, since the pin 1, insert 14 and core wire 8 are strongly urged against each other, the core wire 8 is firmly held in the pin 1 so as not to be removed from the pin and is positively connected to the pin 1 electrically and mechanically at least by the above-mentioned portions 25, 26, 23, 22. Incidentally, two or more portions of the pin may be crimped so as to be deformed by means of the punch 21.

Thereafter, the spring sleeve 6*a* is fitted onto the outer peripheral surface of the insulation member 6 and then the shield lines 9 are connected to the spring sleeve 6*a*. Lastly, the insulation resin cap 10 previously fitted on the conductor lead 7 is attached to the outer surface of the spring sleeve 6*a*, thereby achieving pin plug A.

A dimensional example now will be described. When an entire length of the insert 14 is about 7 mm, a length of the large diameter portion 11*a* is selected to be about 1.5 mm and a length of the small diameter portion 11*b* is selected to be about 5.5 mm. Further, the outer diameter of the large diameter portion 11*a* is greater than the inner diameter of the pin 1 by about 0.1–0.5 mm (for example, 0.35 mm) and the outer diameter of the small diameter portion 11*b* is smaller than the inner diameter of the pin 1 by about 0.5–1.0 mm (for example, when the outer diameter of the small diameter portion is smaller than the inner diameter of the pin by 1.0 mm, a gap of about 0.5 mm is therefore formed around the small diameter portion 11*b*).

Figure 6:
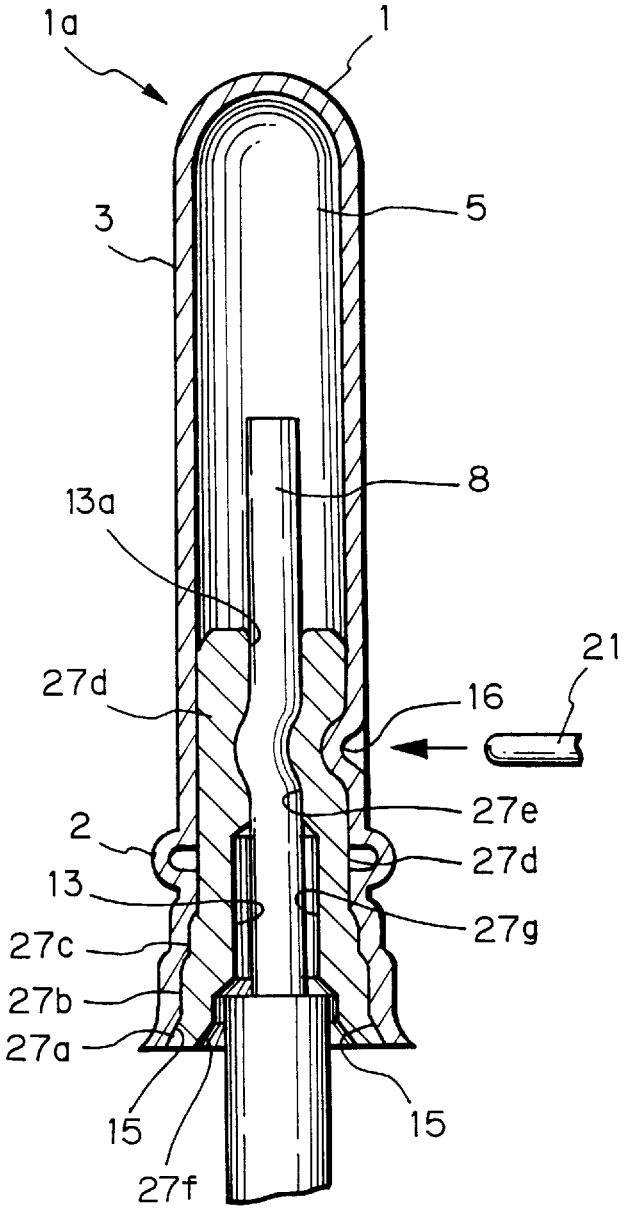
FIG. 6 is an enlarged sectional view of a main portion of a pin plug according to another embodiment of the present invention.
Figure 7A:
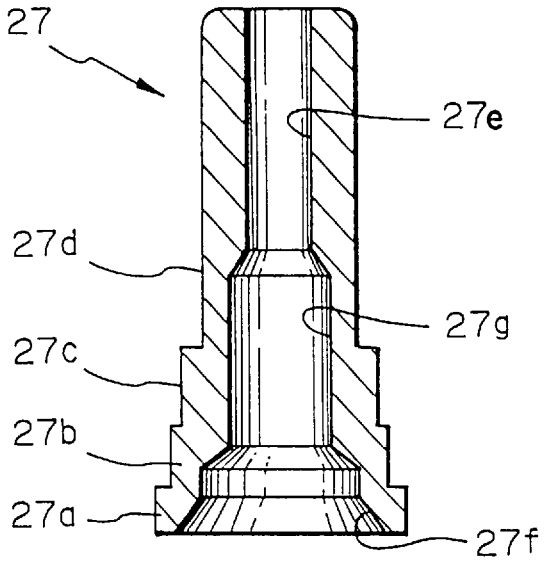
FIG. 7(A) is a sectional view of an insert of the pin plug of FIG. 6.
Figure 7B:
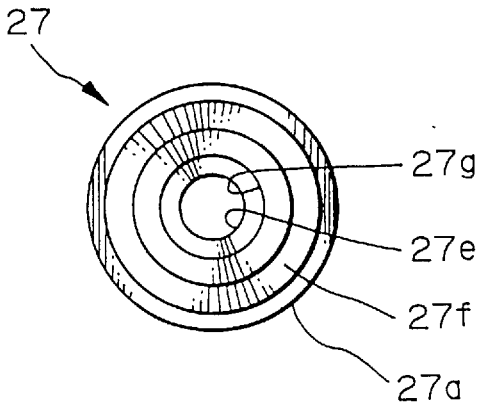
FIG. 7(B) is a plan view of the insert.

FIGS. 6–7(B) show another embodiment of the present invention. In these figures, the same elements as those shown in FIGS. 2–5(B) are denoted by the same reference numerals and detailed explanation thereof will be omitted. In FIGS. 7(A) and 7(B), an insert 27 made of copper includes a largest diameter portion 27*a*, a large diameter portion 27*b*, an intermediate diameter portion 27*c* and a small diameter portion 27*d* which have diameters that are smaller successively from a bottom of the insert. The insert 27 also has a central bore 27*g* including a bore portion 27*e* having an inner diameter substantially the same as the outer diameter of the core wire 8 and a lower end opening 27*f*.

As shown in FIG. 6, the insert 27 is inserted into the pin so that the large diameter portion 27*b* and the intermediate diameter portion 27*c* are press-fitted against the inner surface of the pin 1 with a step. The largest diameter portion 27*a* positionally corresponding to the lower end opening 27*f* is enlarged to facilitate the insertion of the core wire 8.

In this case, an outer diameter of the small diameter portion 27*d* of the insert 27 is slightly greater than the outer diameter of the small diameter portion 11*b* of the first insert 14 shown in FIG. 5. Thus, when the insert 27 is inserted into the pin 1, a gap between the outer peripheral surface of the small diameter portion 27*d* and the inner peripheral surface of the pin 1 is smaller than the gap (about 0.5 mm) in FIG. 3 and becomes about 0.3 mm. Accordingly, during the caulking or crimping operation using the punch 21, the possibility of shifting of the insert 27 is further reduced.

Further, in this embodiment, the two diameter portions 27*b*, 27*c* having different diameters are steppingly press-fitted against the inner surface of the pin 1. Thus, even if there is variation in dimension between an inner diameter of each of the pins 1 and an outer diameter of each of the inserts 27, such variation is accommodated by the two outer diameter portions of the insert 27, thereby always achieving a good press-fit condition of the insert 27.

What is claimed is:

1. A pin plug comprising:

a hollow conductive pin having an opening at an end thereof;

a hollow conductive insert fitting within said pin through said opening thereof, said insert including a small diameter inner portion having an outer diameter slightly smaller than an inner diameter of said pin, a large diameter outer portion press fit into said pin and deforming outwardly an end portion thereof to thereby secure said insert to said pin, a central bore including a reduced diameter bore portion, and an end opening to said bore;

a coaxial cable conductor lead including a core wire inserted through said end opening into said bore in said insert, said core wire fitting into said reduced diameter bore portion and having a diameter corresponding to an inner diameter thereof, and said conductor lead further including shield lines;

a crimp formed in an outer portion of said pin, said crimp being deformed inwardly and deforming said insert and said core wire, thereby integrally securing said pin, said insert and said core wire and forming mechanical and electrical connections therebetween;

an insulation member secured about said pin; and a conductive member attached to said insulation member and not contacting said pin, said shield lines being connected to said conductive member.

2. A pin plug as claimed in claim 1, wherein said conductive member comprises a metal sleeve surrounding said insulation member.

3. A pin plug as claimed in claim 1, wherein said insulation member comprises a member secured to said pin by injection molding of said insulation member about said pin.

4. A pin plug as claimed in claim 1, wherein said pin is press fit into said insulation member.

5. A pin plug as claimed in claim 1, wherein said insert further includes an intermediate diameter portion between said small diameter inner portion and said large diameter outer portion, said intermediate diameter portion having an outer diameter smaller than an outer diameter of said large diameter outer portion and larger than said outer diameter of said small diameter inner portion, said intermediate diameter portion being press fit into said pin and deforming outwardly a corresponding portion thereof.

* * * * *